United States Patent [19]

Mitter

[11] 4,082,036

[45] Apr. 4, 1978

[54] INK TROUGH DIVIDERS FOR ENDLESS BAND SCREEN PRINTER

[75] Inventor: Mathias Mitter, Schloss Holte, Germany

[73] Assignee: Mitter & Co., Schloss Holte, Germany

[21] Appl. No.: 672,074

[22] Filed: Mar. 30, 1976

[30] Foreign Application Priority Data

Apr. 3, 1975 Germany ..... 2514586

[51] Int. Cl.[2] ..... B41F 15/10; B41F 15/40

[52] U.S. Cl. ..... 101/122

[58] Field of Search ..... 101/122, 124, 119, 123, 101/120, 115, 363, 364, 350, 208, 210

[56] References Cited

U.S. PATENT DOCUMENTS

| | | | |
|---|---|---|---|
| 1,315,174 | 9/1919 | Welsh | 101/364 |
| 1,939,965 | 12/1933 | Flockhart | 101/123 |
| 2,800,075 | 7/1957 | Rose | 101/115 |
| 2,887,049 | 5/1959 | Mueller | 101/364 |
| 2,891,474 | 6/1959 | Smejda | 101/365 |
| 3,236,178 | 2/1966 | Worthington | 101/365 |
| 3,336,689 | 8/1967 | Miller | 101/127.1 X |
| 3,339,485 | 9/1967 | Rytterholm | 101/363 |
| 3,831,517 | 8/1974 | Wagner | 101/208 |
| 3,847,076 | 11/1974 | Vasilantene | 101/122 |
| 3,921,520 | 11/1975 | Zimmer | 101/120 |

FOREIGN PATENT DOCUMENTS

| | | | |
|---|---|---|---|
| 2,258,891 | 6/1974 | Germany | 101/109 |
| 2,300,290 | 7/1974 | Germany | 101/122 |
| 2,305,443 | 8/1974 | Germany | 101/120 |

*Primary Examiner*—Ronald E. Suter
*Attorney, Agent, or Firm*—Michael J. Striker

[57] ABSTRACT

A screen printing machine has an endless stencil which is trained about a plurality of supporting rollers. A squeegee roller defines with a portion of the inwardly directed stencil surface a trough into which printing medium can be fed to form a medium pool therein. Confining elements extend across the trough at locations spaced lengthwise of the same and have surface portions which sealingly and slidably engage the squeegee roller and the inwardly directed stencil surface, respectively, to prevent undesired escape of printing medium from the pool.

21 Claims, 4 Drawing Figures

INK TROUGH DIVIDERS FOR ENDLESS BAND SCREEN PRINTER

Figure 1:
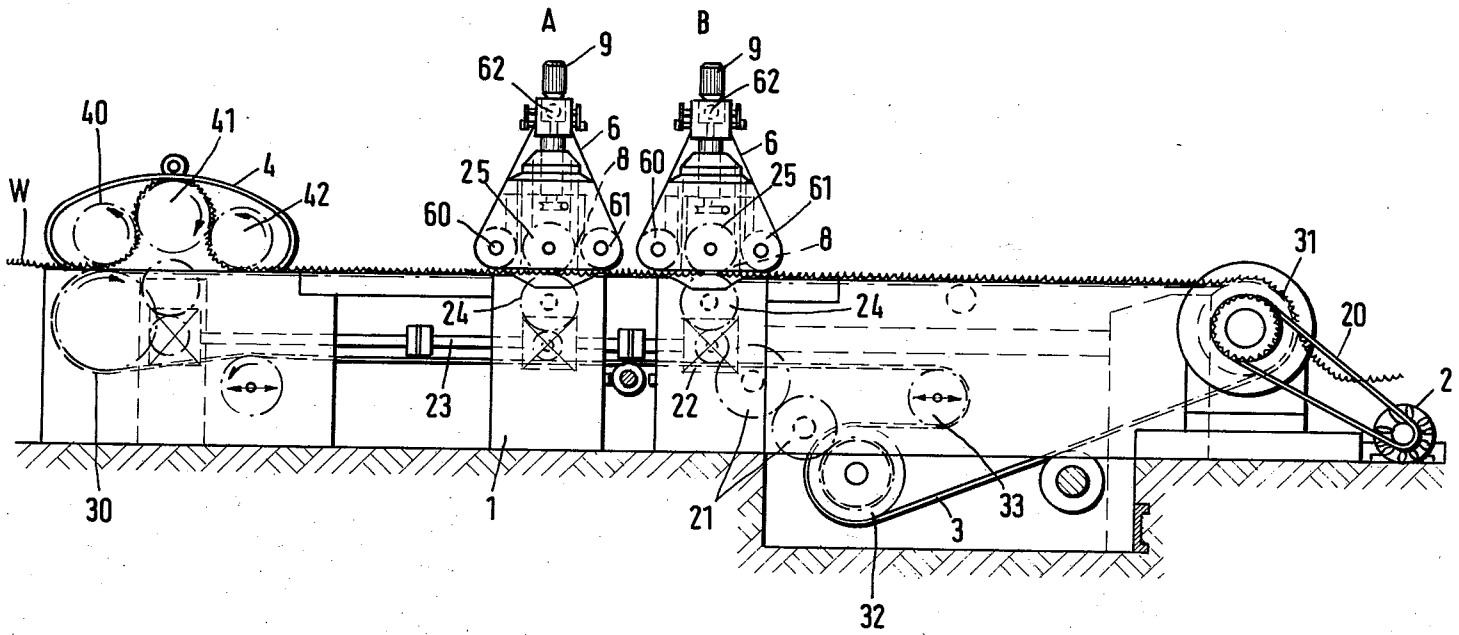

The invention relates to a screen printing machine with an endless screen-printing stencil belt spanned over rollers held in lateral bearings, wherein a driven scraper roller is arranged between two mutually parallel rollers lying in the working plane of the machine and wherein a printing medium is fed to the scraping roller over its entire width so that a pool of the printing medium is formed in front of it.

Such screen printing machines are known. The stencil belts are formed of a very thin material having very fine perforations, screening, or a thin sheet. The stencil belts are made impervious to ink, for instance by applying a layer of lacquer at the locations at which no printing is to be effected. Ink or any other type of printing medium is fed to these stencils, wherein in the following printing presses are described which use ink without excluding the application of other printing mediums. The feeding of the printing medium takes place in general by means of a tube provided with ink-output holes and this printing medium is pressed through the stencil by means of a scraper. So-called scraper generally called a squeegee roller in this art rollers are known and used according to the present invention, this term excluding flat planar scrapers which are not used in the above-given case. This scraper roller or roller scraper presses the ink with very precise dosing through the openings in the stencil on to the workpiece web which is supported by means of a counter pressure beam or by means of a counter roller.

It is already well known to provide such scraper rollers with a drive wherein a drive gear is provided at the axis of the scraper roller as described for example in Swiss Pat. No. 523,144 of the instant applicant. As the ink or the like is fed to the scraper roller, a so-called ink wedge is formed in front of the roller and the pressure relationships within this ink wedge are adjustable in various possible manners. On one hand there is the effect of viscosity of the ink and on the other hand the depth of the ink wedge, that is the amount of ink fed in per unit time relative to the speed. In this manner the ink builds up more or less in front of the scraper roller. Of course it is possible on the other hand to change the drive speed as well as the stencil or even the scraper roller and by changing the given differences of the speeds differences can be created in the ink wedge. According to the pressure used the ink application is heavier or lighter. The ink can emerge through the openings of the stencil belt as from nozzles.

The disadvantage of the above-described screen-printing machine is that a lateral flowing in the printing region of the stencil band of the ink wedge is unavoidable, as it has not been possible to provide lateral limits in such stencil belts. For this reason there are differences across the overall width of the scraper roller, namely considerable pressure drop at the edge regions, so that the desired ink intensity is not produced on the goods. It is known to provide ink limiters for scraper rollers by providing plates on the shaft of the scraper roller. The disadvantage of such ink-space limiters is that they are not useable in screen-printing machines with stencil belts of the above-described type or can only be used outside the stencil region, for instance at the edges of the stencil. In addition, a disadvantage of the above-described ink-space limiters is that they lead to smearing at the edge regions.

It is an object of the present invention to provide a screen-printing machine of this type wherein the limiting of the inking space, that is of the application space of the printing medium, is also effected in the stencil region so that at the desired spaces and across the desired width it is possible to obtain regular pressure relationships in the ink wedge between the screen-printing stencil belt and the outer surface of the scraper roller.

In accordance with the invention ink-space limiters are provided which engage snugly on one side against the scraper roller.

This has the effect that by use of this ink-space limiter, which advantageously is adjustable and replaceable, the inking room is limited to the space which is desired by the printer, and that inside this region in the so-called inking wedge uniform pressure relationships are present, which relationships can be changed for instance by feeding in more or less ink or by changing the speeds, or the like. The provision of the ink-space limiter makes possible an exact and uniform control of the ink over the entire width. It is of course possible to provide a larger number of ink-space limiters so that different relationships can be obtained section by section.

Figure 2:
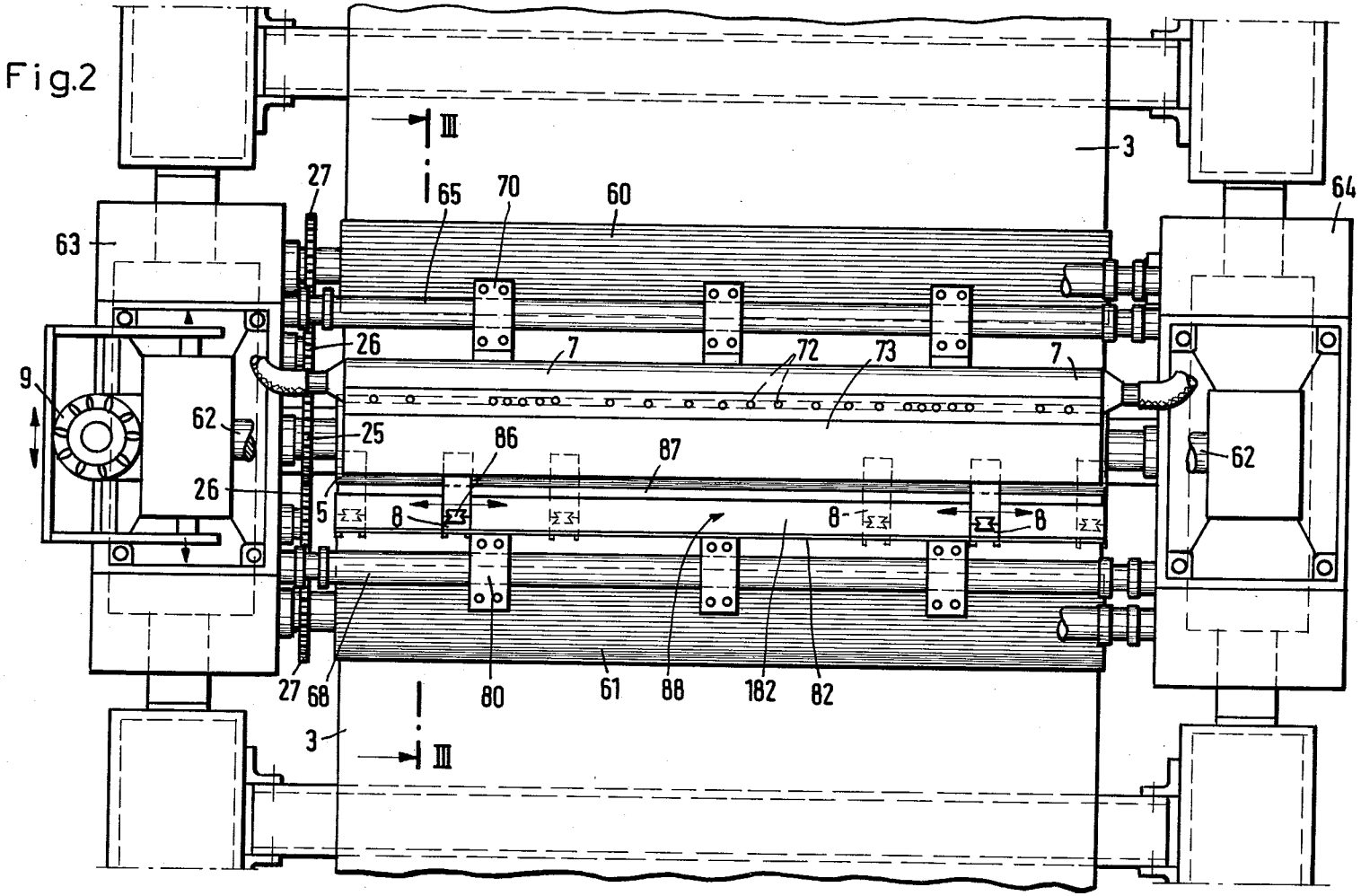
Figure 4:
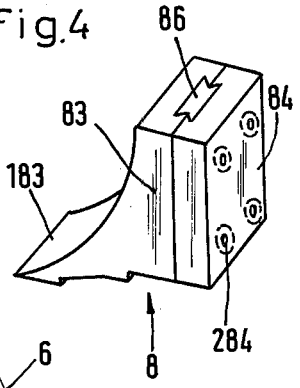
Figure 3:
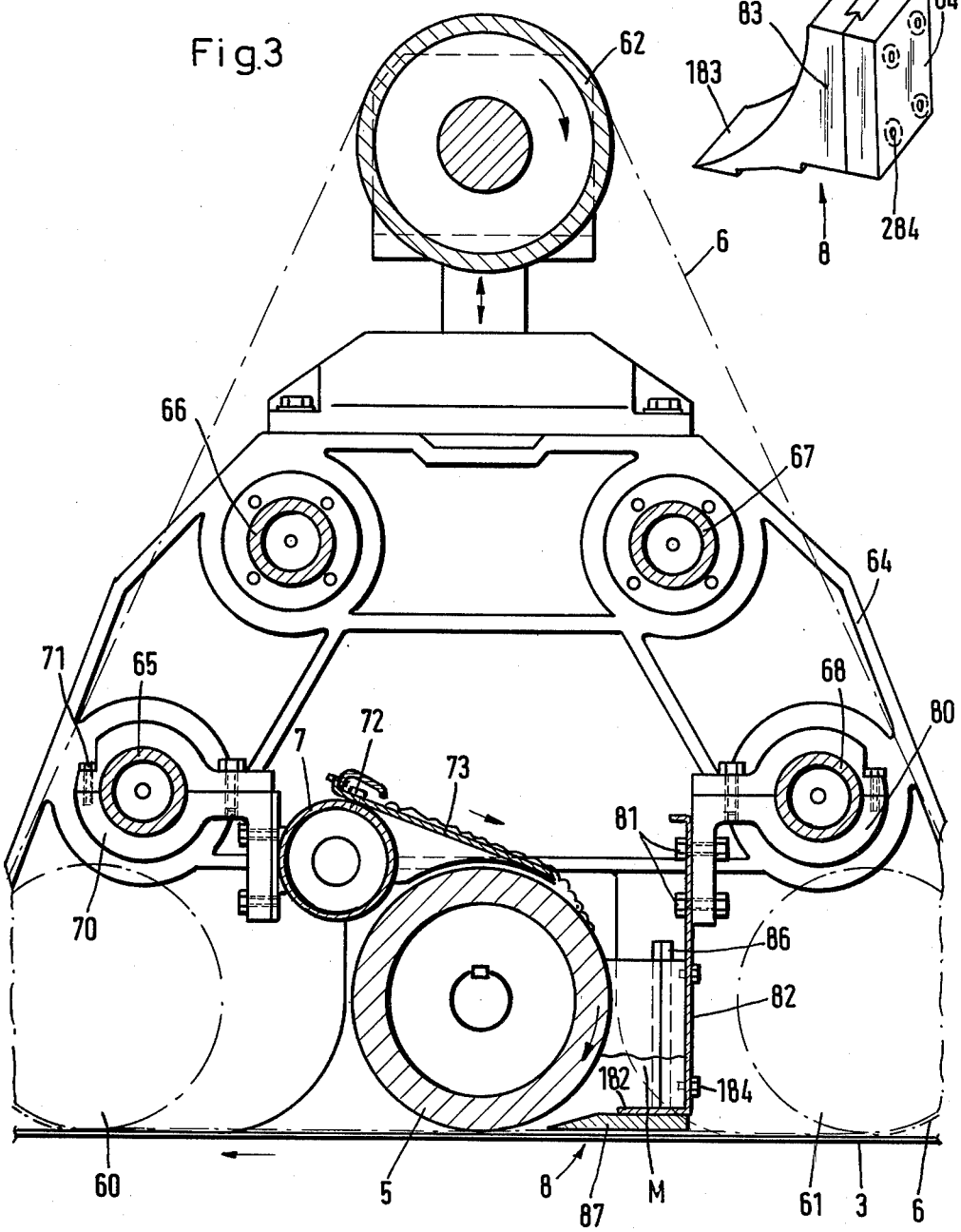

The drawing shows an embodiment of the invention. There is shown in:

FIG. 1 a side view of a screen-printing machine,

FIG. 2 a printing station of the screen-printing machine seen in top view with the stencil removed, FIG. 3 a section along line III–III of FIG. 2, FIG. 4 an example of the principal parts of ink-space limiter in perspective view.

The screen-printing machine according to the invention has as is known a machine frame 1 on which a row of pressing units A, B are provided. In the illustrated example two such pressing units are shown; any desired number can be provided.

In the machine which is driven by a motor 2 there is an endlessly continuous printing blanket 3 which is suspended over rollers 30 and 31 at its front and rear ends and endlessly advances and in its upper reach supports a workpiece web W. It can be carpet goods or other lighter quality goods such as paper, non-woven material, or the like.

At the input side of the machine there is a feed device 4 with rollers 40, 41, and 42 which are driven so that a uniform feed of the workpiece web at a desired speed is achieved. The printing stations are in this example driven by a main motor 2 which drives the roller 31 by means of a chain or belt drive 20 so that the pressing blanket 2 drives the main drive roller 32. In order to insure this a tensioning roller 33 is provided for the pressing blanket 3. This is one drive type.

A main drive shaft 23 is itself driven by means of a transmission having gears or the like as well as a right-angle drive 22 so that uniform operation of pressing units is insured.

Gears 24 entrain drive gears 25 through which each of the scraper rollers 5 inside a pressing unit is driveable.

Inside each pressing unit there are in the illustrated example three rollers, namely rollers 60, 61, and 62, with roller 62 functioning as a tensioning or adjusting roller and positioned between and above the two rollers 60 and 61 lying in the working plane.

The height of the roller 62 can be adjusted in a vertical plane.

A screen-printing stencil belt 6, hereinafter referred to as a stencil belt, is spanned over the three rollers 60, 61 and 62. The stencil belt can be spanned over only two rolls in other embodiments of screen-printing stencils, even as it is possible to provide a greater number of rollers in this region. The drive of the lower rollers 60 and 61 is effected in each printing station by a gear wheel 25 through intermediate gears 26 to the roller gears 27. The entrainment of the screen-printing stencil is frictional. If necessary the rollers 60 and 61 can be roughened or have a textured surface in order to insure the entrainment of the stencil band 6. The stencil band is controlled by a motor 9 which constitutes the journal for displacing the upper rolls 62 in the direction of the double-headed arrow of FIG. 2. FIG. 2 does not show the upper roller 62, this Figure only shows the shaft end thereof.

Rollers 60 and 61 are seated in adjustable lateral bearings 63 and 64 in the machine frame 1. In this manner the pressing unit can be positioned exactly relative to the passing goods or to the printing blanket 3. In the illustrated example of FIG. 2 the goods are not shown, only the printing blanket 3 is shown.

The scraper roller 5 can have its own drive. It is also possible to drive this scraper roller by friction as is known.

Both lateral bearings 63 and 64 of each printing station are connected together by traverses 65, 66, 67 and 68, the lower traverses serving as supports with the traverse 66 holding an ink feed tube and a traverse 67 holding a limiting means for the printing medium, for example ink or the like.

A plurality of clamps 70 for holding the ink feed tube 7 are positioned on the traverse in the illustrated example. These are simple clamps which can be tightened by means of screws 71. This ink feed tube 7 has upwardly directed nozzles 72 and a feed plate or baffle 73 overreaching the scraper roller 5, with a not-illustrated pump forcing ink to flow out of the nozzles 72 and down the upper surface of the feed plate 73. In this manner the ink flow is equalized and flows in the illustrated arrow direction to the scraper roller 5 to form before the scraper roller 5 the so-called medium pool. The height, therefore the depth, can be determined by known means. It is shown at M in the drawing.

The scraper roller 5 lies in the plane of the lower rollers 61 and 62 and forces the ink or any other desired printing medium through the screen-printing stencil bend 6. The screen-printing stencil band itself is provided in known manner with previous regions so as to insure the formation of the desired image.

The further traverse 68 carries the means which limits the medium pool, which is usually formed of ink. A plurality of clamps 80 are secured to the traverse 68 and an upright plate 82 having at its lower end a lip 182 is secured to these clamps 80 by means of screws 81. This plate is formed of resiliently deformable sheet metal. The plate 82 can be vertically and horizontally adjusted by loosening of the screws 81. On its lower lip 182 are provided ink-space limiters 8 which are more clearly shown in FIG. 4.

The ink-space limitors 8 each consist of two blocks 83 and 84. These blocks 83 and 84 have different functions, the block 84 serving as mounting block and the block 83 having a cylinder segment 183 with which it fits snugly on the outer surface of the scraper roller 5. Both parts are connected together by means of a bar 86 which is formed as a double dovetail and therefore constitutes a force-transmitting and easily releasable connection. This arrangement is clearly visible in FIGS. 3 and 4. The mounting block 84 is secured by screws 184 on the plate 82 and has corresponding threaded bores 284 that receive these screws.

The plate 82, which is formed of resiliently deformable sheet metal and which insures a spring urging of the ink-space limiters on the scraper roller, virtually forms an ink reservoir and extends over the entire width of the printing unit and only is provided at a few locations with ink-space limiters, namely at its ends. The plate 82 is provided on its lower side toward the stencil over the entire width of the printing unit with a replaceable plate 87 which may be screwed on and is formed of low-friction material. In this manner the friction between the plate 82 building the ink reservoir and the screen-printing stencil belt 6 is reduced. The plate 82, the plate 87 and the ink-space limiters 8 delimit the medium pool M which lies ahead of the scraper roller 5 and which is continually renewed by the ink-feed tube 7, advantageously over the feed plate 73.

The ink-space limiters are advantageously made of synthetic resin material, one of the low-friction resins, so that the block 83 can be easily replaced when its surface is worn down by the continuously rotating roller 5. In addition it is possible to clean the ink-space limiters by pulling out the block 83.

It is possible to arrange two ink-space limiters at the end regions of the stencil or the printing station. FIG. 2 shows in dash lines that other positionings are possible, for instance the provision of additional ink-space limiters over the entire width so that ink-space sections in the intermediate spaces 88 between two adjacent ink-space limiters 3 are formed. In addition, FIG. 2 also shows the possibility of arranging the nozzles 72 so that more ink is fed into some of the spaces 88 between two ink-space limiters than into neighboring intermediate spaces. In this manner it is possible to obtain with the ink-space limiters different inking during printing, since the relationships in the medium pool or in the ink wedge before the scraper roller can be varied by feeding in more or less ink or another printing medium. If the medium pool is deep more ink is pressed through the stencil than if it is shallow.

Of course the scope of the invention is not limited to the illustrated examples, the ink-space limiters can be formed otherwise than as shown, although the illustrated embodiments have considerable advantages. It is essential that by proper positioning of the ink-space limiters the medium pool is limited so as to flow evenly over the entire upper side.

I claim:

1. A screen printing machine, comprising an endless printing screen an inwardly directed screen surface of which bounds a space having opposite open ends; a plurality of supporting rollers extending through said space and mounting said printing screen for travel in an endless path in which a part of said printing screen forms a printing run; a driven squeegee roller also extending through said space and having a circumferential surface defining with a portion of said inwardly directed screen surface of said printing screen a trough which extends axially of said squeegee roller and is located ahead of the same, as considered in the direction of travel of said printing screen; means for feeding flowable printing medium into said trough so that the medium forms a pool therein; and confining means extending across said trough at locations which are spaced lengthwise of said trough, for confining the medium therein, said confining means comprising confining elements each having a curved first surface shaped to snugly conform and partly surround said circumferential surface of said squeegee roller and extending to said inwardly directed screen surface and a second surface juxtaposed in sealing contact with said inwardly directed screen surface which slides past said second surface so as to prevent escape of said printing medium between said second and said inwardly directed surfaces while permitting unobstructed travel of said printing screen in said endless path.

2. A screen printing machine as defined in claim 1; and further comprising elements for replaceably mounting said confining elements.

3. A screen printing machine as defined in claim 1; and further comprising means for resiliently urging said confining elements against the circumference of said squeegee roller.

4. A screen printing machine as defined in claim 1, wherein said confining elements each have a mounting portion, a detachable portion having said first surface, and connecting means for detachably connecting said detachable portion.

5. A screen printing machine as defined in claim 1, wherein said confining elements each have a mounting portion, a detachable portion having said first surface, and connecting means for detachably connecting said detachable portion to said mounting portion so that said first surface is in engagement with said squeegee roller, at least said detachable portion being of synthetic plastic material having a low coefficient of friction.

6. A screen printing machine as defined in claim 1, wherein said confining elements each have a mounting portion, a detachable portion having said first surface and connecting means for detachably connecting said detachable portion to said mounting portion so that said first surface is in engagement with said squeegee roller, both of said portions being of synthetic plastic material having a low coefficient of friction.

7. A screen printing machine as defined in claim 1, said supporting rollers having respective axial end portions which extend outwardly beyond said space; and further comprising bearing means outwardly adjacent said opposite open ends and journalling said supporting rollers or rotation.

8. A screen printing machine as defined in claim 7; further comprising connecting elements connecting said bearing means which are located at said opposite open ends; said feeding means comprising a supply tube carried by one of said connecting elements; and further comprising a support member carried by another of said connecting elements and extending lengthwise of said trough, said confining elements being carried by said support member.

9. A screen printing machine as defined in claim 8, wherein said support member is of resiliently yieldable sheet material.

10. A screen printing machine as defined in claim 9, wherein said support member urges said confining elements into resiliently yieldable engagement with the circumference of said squeegee roller.

11. A screen printing machine as defined in claim 8, wherein said support member is of sheet material, coextensive with the elongation of said trough, and in part bounds said trough in substantial longitudinal parallelism with said squeegee roller.

12. A screen printing machine as defined in claim 11, wherein said sheet-material support member is strip-shaped and has an upright orientation, said support member having a lower edge region formed with a portion projecting towards said squeegee roller, said confining elements being supported on said portion.

13. A screen printing machine as defined in claim 12, said support member further comprising a strip-shaped component located beneath and removably mounted on said portion, said component projecting beyond said portion substantially to said squeegee roller and having a free edge defining with the circumference of said squeegee roller a gap which communicates said trough with said inwardly directed surface of said printing screen that faces towards said squeegee roller.

14. A screen printing machine as defined in claim 1; further comprising a strip-shaped resiliently yieldable sheet-material element extending lengthwise of said trough substantially parallel to said squeegee roller and supporting said confining elements; and further comprising securing means securing said sheet-material element and being releasable so that said sheet-material element can be re-positioned in vertical and longitudinal directions relative to said squeegee roller.

15. A screen printing machine as defined in claim 1, wherein said confining means comprises at least three of said confining elements spaced from one another lengthwise of said trough so that the trough is subdivided into respective discrete compartments.

16. A screen printing machine as defined in claim 15; further comprising an ink supply tube for supplying ink as printing medium into said trough, said tube having a part extending into said space and which is provided with first and second nozzle means for discharging ink into the respective compartments.

17. A screen printing machine as defined in claim 1; further comprising an ink supply tube located at a side of said squeegee roller remote from said trough, for supplying ink as printing medium into said trough, said ink supply tube having ink outlets located at a level above said squeegee roller and said trough; and further comprising an ink guiding baffle downwardly inclined from said ink supply tube to said trough and extending over said squeegee roller.

18. A screen printing machine, comprising an endless printing screen an inwardly directed surface of which bounds a space having opposite open ends; a plurality of supporting rollers extending through said space and mounting said printing screen for travel in an endless path in which a part of said printing screen forms a printing run; a driven squeegee roller also extending through said space and having a circumferential surface defining with a portion of said inwardly directed surface of said printing screen a trough which extends axially of said squeegee roller and is located ahead of the same, as considered in the direction of travel of said printing screen; means for feeding flowable printing medium into said trough so that the medium forms a pool therein; and confining means extending across said trough at locations which are spaced lengthwise of said trough, for confining the medium therein, said confining means comprising elements each having a curved first surface shaped to snugly conform and partly surround said circumferential surface of said squeegee roller and a second surface juxtaposed with said inwardly directed surface which slides past said second surface, said confining elements each having a mounting portion, a detachable portion having said first surface, and connecting means for detachably connecting said detachable portion to said mounting portion, said portions of each of said confining element being formed with respective recesses, and said connecting means comprising a connecting element matingly received in said recesses and connecting said portions with one another.

19. A screen printing machine as defined in claim 18, wherein said recesses are grooves, and said connecting element is a bar.

20. A screen printing machine as defined in claim 18, wherein said recesses are grooves of dovetail-shaped cross-section, and said bar is of double-dovetail shaped cross-section and is in part received in each of said grooves.

21. A screen printing machine, comprising an endless printing screen, an inwardly directed screen surface of which bounds a space having opposite open ends; a plurality of supporting rollers extending through said space and mounting said printing screen for travel in an endless path in which a part of said printing screen forms a printing run; a driven squeegee roller also extending through said space and having a circumferential surface defining with a portion of said inwardly directed screen surface of said printing screen a trough which extends axially of said squeegee roller and is located ahead of the same, as considered in the direction of travel of said printing screen; means for feeding flowable printing medium into said trough so that the medium forms a pool therein; confining means extending across said trough at locations which are spaced lengthwise of said trough, for confining the medium therein, said confining means comprising confining elements each having a curved first surface shaped to snugly conform and partly surround said circumferential surface of said squeegee roller and extending to said inwardly directed screen surface and a second surface juxtaposed with said inwardly directed screen surface which slides past said second surface; and means mounting the respective confining elements for movement to any of a plurality of positions spaced lengthwise of said trough.

* * * * *